United States Patent [19]

Gundlach

[11] 4,345,439

[45] Aug. 24, 1982

[54] SNOWMAKING METHOD AND APPARATUS

[75] Inventor: Robert W. Gundlach, Victor, N.Y.

[73] Assignee: Vencraft Corp., West Henrietta, N.Y.

[21] Appl. No.: 122,837

[22] Filed: Feb. 20, 1980

[51] Int. Cl.[3] ..... F25C 5/12

[52] U.S. Cl. ..... 62/71; 62/74; 62/320; 272/56.5 SS

[58] Field of Search ..... 62/71, 320, 347, 354, 62/235, 73, 74; 239/2 S; 272/56.5 SS, 3

[56] References Cited

U.S. PATENT DOCUMENTS

| | | | |
|---|---|---|---|
| 305,551 | 9/1884 | Vieweger | 62/235 |
| 2,066,431 | 1/1937 | Taylor | 62/354 X |
| 2,259,841 | 10/1941 | Spiegl | 62/354 X |
| 2,676,471 | 4/1954 | Pierce, Jr. | 272/56.5 SS |
| 3,000,189 | 9/1961 | Bert | 62/320 |
| 3,371,505 | 3/1968 | Raver et al. | 62/354 X |
| 3,580,008 | 5/1971 | Barnard et al. | 62/347 |
| 3,706,414 | 12/1972 | Dupre | 239/2 S X |
| 4,075,868 | 2/1978 | Bartholmey | 62/347 |

*Primary Examiner*—William E. Tapolcai, Jr.
*Attorney, Agent, or Firm*—Raymond C. Loyer

[57] ABSTRACT

The invention resides in a method of producing artificial snow directly from ice, for ski slopes. Ice is formed on a surface exposed to an ambient temperature at or below the freezing temperature of water by flowing water onto the surface. The rate of water deposition is controlled such that all of the water deposited on the surface freezer before additional water is deposited thereon. The ice is then comminuted into snow-like particles and distributed onto the slope.

7 Claims, 6 Drawing Figures

SNOWMAKING METHOD AND APPARATUS

PRIOR ART STATEMENT

The production of snow-like substances or "artificial" snow has been of interest for a long period of time. The main purposes for making such products includes the storage and transportation of perishable commodities such as garden vegetables and fruit. More recently, the making of artificial snow for the purpose of coating a slope or hill on which skiing can be performed has created a large industry for manufacturers of artificial snow-making equipment.

The most popular technology for the creation of artificial snow for outdoor use involves high pressure fluids such as air, steam or water, or combinations thereof. These fluids are forced through special nozzles which dispense small particles of water into the air. Typical examples of such technology can be found in U.S. Pat. Nos. 2,571,069; 2,676,471; 3,372,872 and 3,494,559. All of the methods described in these patents utilize large amounts of energy by compressers which force the fluids through the nozzle into the air. In U.S. Pat. No. 2,676,471 there is a very general reference to an alternative method for coating a slope with artificial snow which involves the creation of cracked or chipped ice from ice blocks. Such an approach is discarded in this prior art for reasons including the cost of the ice blocks or the cost of distribution of the ice which is made at a point remote from the slope.

Although the method of making artificial snow by means of compressed fluids is now widely used commercially, a careful study reveals that such methods consume large amounts of energy and require expensive equipment. Because the expenditure of energy has become more than casual, means for "non-essential" commodities such as artificial snow on slopes or hills should not deprive other, more essential uses of energy.

Although not generally considered as a feasible means to provide large quantities of artificial snow on the slopes, the comminuting of ice into small particles had been widely used commercially for preserving food before the advent of modern refrigerating means. Typical examples of the art are found in U.S. Pat. Nos. 2,234,425; 2,416,432 and 2,602,303. The last mentioned patent teaches a self-propelled apparatus which crushes and transports crushed ice from blocks of ice. The small particles are distributed into railroad cars for immediate use as a coolant.

Accordingly, the prior art has disregarded the conversion of ice into a snow-like product for outdoor use such as skiing in favor of high pressure methods for delivering fluids into the air in the form of small droplets.

SUMMARY OF THE INVENTION

This invention relates generally to a method and apparatus for making artificial snow from ice and more particularly to a method and apparatus for providing large amounts of artificial snow for ski slopes from ice, directly.

It is an object of this invention to provide a method and apparatus which will produce artificial snow in large amounts for outdoor use with greatly reduced need for energy consumption.

Another object of this invention is to provide a low energy consuming system for making ice along ski slopes and converting it to snow and distributing it over the ski slope.

Another object of this invention is to provide apparatus which conveniently converts water into artificial snow.

A further object of this invention is to provide a method and apparatus for producing low density snow ideally suited to skiing purposes.

These and other objects will appear from the following description of this invention.

In accordance with this invention there is provided an extremely energy efficient method for producing ice and, in turn for converting said ice into snow along remote areas such as ski slopes which comprises freezing water by depositing a film of water on a surface which is exposed to an ambient atmosphere at or below the freezing temperature of said water. The rate of water deposition is controlled such that all of the water placed on the surface freezes before additional water is allowed to be deposited thereon. The proper rate of water deposition has been determined and is depended upon the ambient temperature and angle of incline of the surface as will be more fully described below.

Generally, water is deposited on a surface at the rate of about $\frac{1}{3}$ mm of thickness per hour per degree Celsius below the freezing point of water of the ambient atmosphere. Humidity of the atmosphere and wind conditions of the atmosphere will allow the above mentioned rate to vary slightly but the primary variable is temperature, or the number of degrees below the freezing point of water.

The term "snow" as used in this specification and claims is intended to mean what is known in the art as "artificial snow". That is, the term is intended to mean a snow-like product comprising small particles of ice crystals derived from a larger portion of ice and obtained by subdividing the larger portion.

The above described method for forming ice has been found to be highly efficient with respect to both energy consumption and time. The only energy required to provide the ice is that required for delivery of the water. High water pressure is not required at the point of delivery of the water. Since ambient atmospheric temperatures are utilized to freeze the water, there is no need to supply any energy to form the ice. The only remaining need for energy is to comminute the ice and deliver it to the ski slope and said amount of energy is relatively small in accordance with this invention.

In accordance with this invention ice is formed along ski slopes in sufficient quantities to provide ample material with which to provide snow when needed on the slope. The average ambient temperatures along ski slopes during the ski season allows for the production of large amounts of ice due to the efficient freezing provided in accordance with this invention. Previously, the time required to provide sufficient quantities of ice in the form of block ice prohibited practical use of block ice for conversion to snow along ski slopes. Thus, the volume of ice per unit of time is greatly increased by the method of this invention over prior art methods of block ice promotion.

The advantageous method of forming ice, in accordance with this invention has many different applications. For example, commercial ice manufacture wherein water is placed in a refrigerated compartment to form ice cubes and blocks of various sizes can now be produced more efficiently by forming the cubes and blocks as a series of thin layers rather than by cooling a static volume of water. In this embodiment water is admitted into the refrigerated compartment from above the ice cube or block forming device at the rate mentioned above. As is well known in the art, the provision of apertures above a refrigerated compartment is practical since the cold, refrigerated air will not be displaced by the warmer and thus less dense air above. Thus a conventional refrigerated compartment and ice forming equipment can be modified by providing apertures in the ceiling and water delivery means at each aperature whereby water is admitted into the refrigerated compartment in accordance with this invention.

DETAILED DESCRIPTION OF THE DRAWINGS

Figure 1:
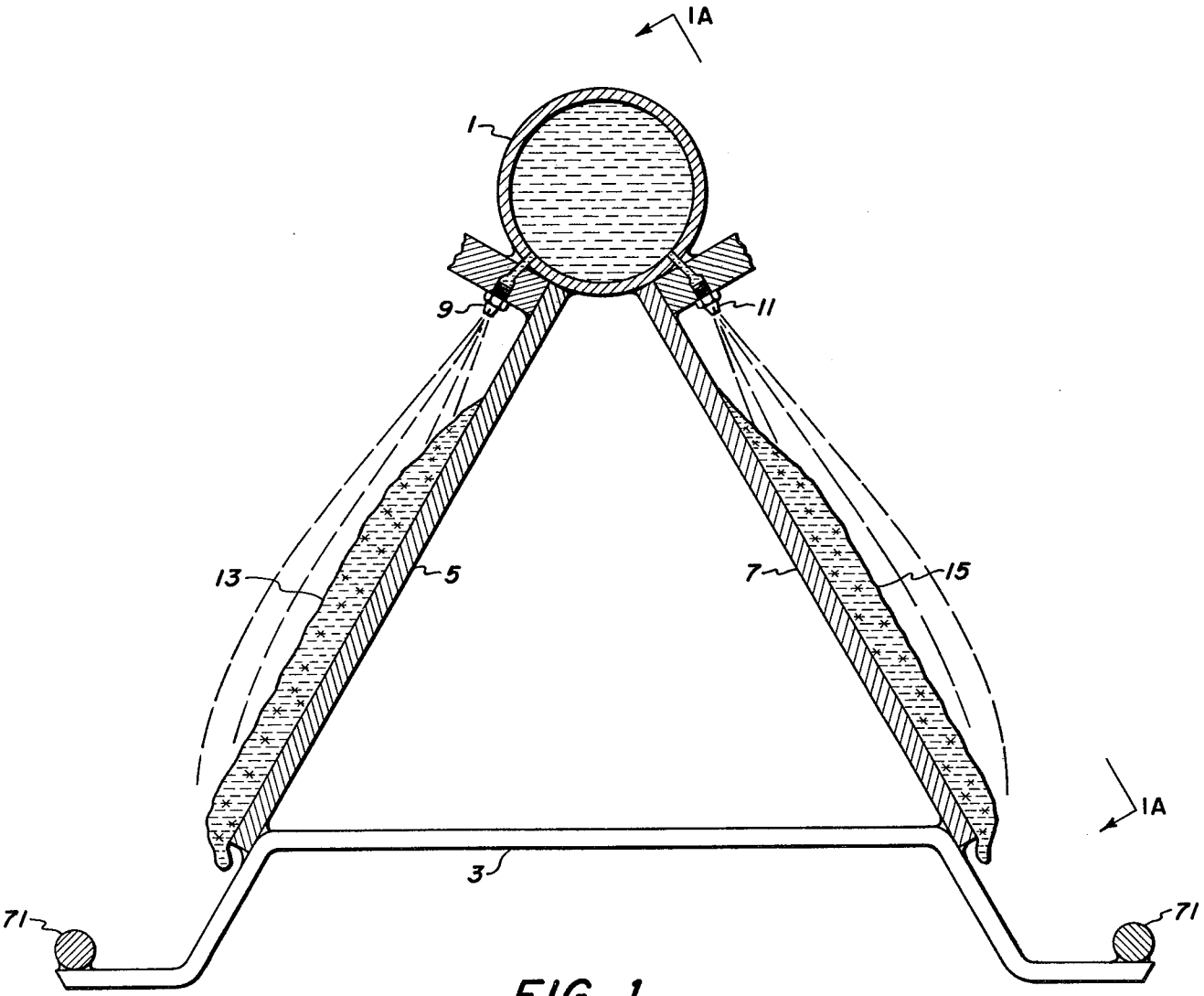
FIG. 1 is an end sectional view of one choice illustrating the method of forming ice in accordance with this invention.

In FIG. 1 there is shown one exemplary form illustrating the method of forming ice in accordance with this invention. Water delivery means pipes 1 which can take many forms is illustrated in FIG. 1 as a pipe running from a source of water supply along a triangular member having a base 3 and two inclined surfaces, 5 and 7. Inclined surfaces 5 and 7 can be of any suitable material such as wood, plastic, foamed plastic, steel, etc. Since the surface is stationery and generally not touched other than by the gentle fall of water droplets, inexpensive materials of sufficient strength are preferred.

Water from multiple ports 9 and 11 in pipes 1 and 1' permit water to be deposited onto inclined surfaces 5 and 7 at the rate specified in accordance with this invention. The water freezes on surfaces 5 and 7 thereby building banks of ice 13 and 15.

The water delivery means can take any suitable form and is generally well insulated from the ambient atmosphere to prevent freezing. For example, pipe 1 can be positioned above rather than below surfaces 5 and 7. The pipe 1 can take the form of perforated tubes, etc. which provide, with correct pressure applied, the proper flow rate to surfaces 5 and 7.

Surfaces 5 and 7 can take the form of a horizontal plane rather than inclined surfaces; however, the rate of freezing on an inclined surface has been observed to be up to about 50% faster than on a horizontal surface, depending upon the angle from the horizontal. A nearly vertical angle has been found to provide the fastest freezing rate.

The amount of water delivered to surfaces 5 and 7 is controlled most conveniently by timed, intermittent delivery from shower heads, sprinklers or the like.

While FIG. 1 shows surfaces 5 and 7 as inclined planes of about 60° from the horizontal, one may select from a wide range of angles. When operating at ambient temperatures close to the freezing point of water, conduction is the major process of heat transfer. Only for large temperature differences, generally well above the freezing point of water, radiation losses exceed losses by conduction. Heat loss by conduction to the air is facilitated by convection to carry the heated air away. A sloping surface promotes greater convection currents. Thus in most instances a preferred, practical system can utilize inclined surfaces up to about 85° from the horizontal.

Figure 1A:
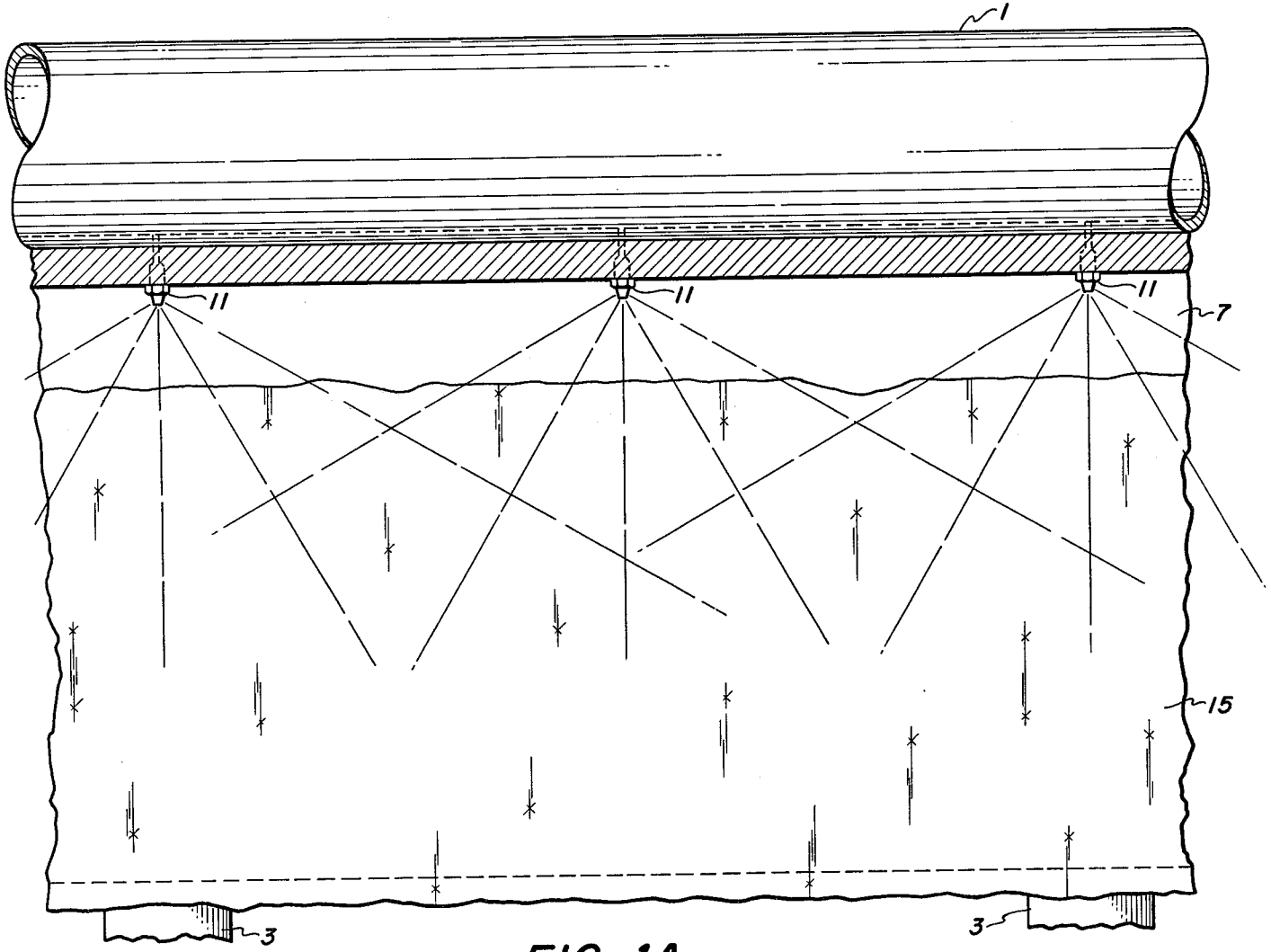
FIG. 1A is a side plan view of a segment of the device in FIG. 1.

In FIG. 1A there is a shown a side view of the device of FIG. 1. Of course, one may envision the device to run the length of a ski slope to provide a bank of ice of sufficient size to cover the slope with snow periodically and to hold further amounts of ice until needed. Water pipes are mounted on a support common with base 3. Ports 11 distribute water uniformly over the area of inclined surface 7 whereupon the water spreads out by the force of gravity. Aided by convection currents crossing surface 7 because of its inclined posture the water quickly freezes before it runs off the bottom. Of course, some water loss near the bottom of surface 7 can be tolerated.

The size of surface 7 will depend upon the average temperature according to past weather records in the area of the ski slope and the width of the ski run. For example, in order to produce 25 cm. of snow over a ski run having a width of 25 meters, each meter of length of the slope must have a ridge of ice 1.25 $m^3$ in volume. This would require a solid mass of triangular shaped ice having a base of 1.7 meters. To form such a ridge in accordance with this invention one would utilize a surface area of about 2 $m^2$ per meter of length. Further, one could form such a ridge in one week with an average temperature of −6° C., which builds up ice at the rate of 2 mm/hr.

Figure 2:
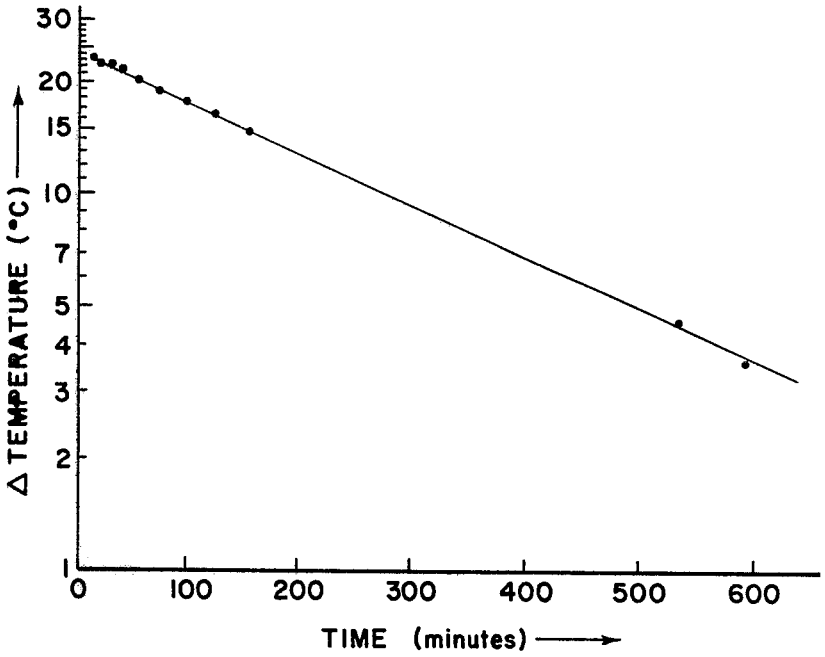
FIG. 2 is a graph illustrating the time factor involved in forming block ice by prior art means.

To provide a graphic comparison of the prior art wherein block ice is proposed to be formed from static bodies of water, there is shown in FIG. 2 a semi-log graph indicating the rate of change in degrees Celsius per unit of time of a 5 gallon volume of water. The data presented in FIG. 2 were obtained by suspending a 5 gallon container (common metal pail having a surface area of 4534 $cm^2$) of water 2 meters above ground level in an ambient temperature of 1° C. for the period of time indicated in FIG. 2. As is shown in FIG. 2, the temperature of the water is reduced slowly. Because the latent heat of fusion of water must be overcome to allow freezing, the time required to freeze water is 80 times longer than the time required to lose 1° C. of temperature. Blocks or trays of water, freezing the outer surfaces first, lose thermal energy more and more slowly, because ice is more insulating than water, and also seals the water against evaporative cooling. For these reasons, large masses of water take relatively long times to freeze compared with thin films of water spread upon any solid mass.

Consider, also, the cost of containers strong enough to hold significant quantities of ice. Then, too, the ice frozen in a container is difficult to get out without destroying the container. In view of the above, the production of block ice, in situ, for conversion to snow for the purpose of skiing has, in the past, been impractical.

Figure 3:
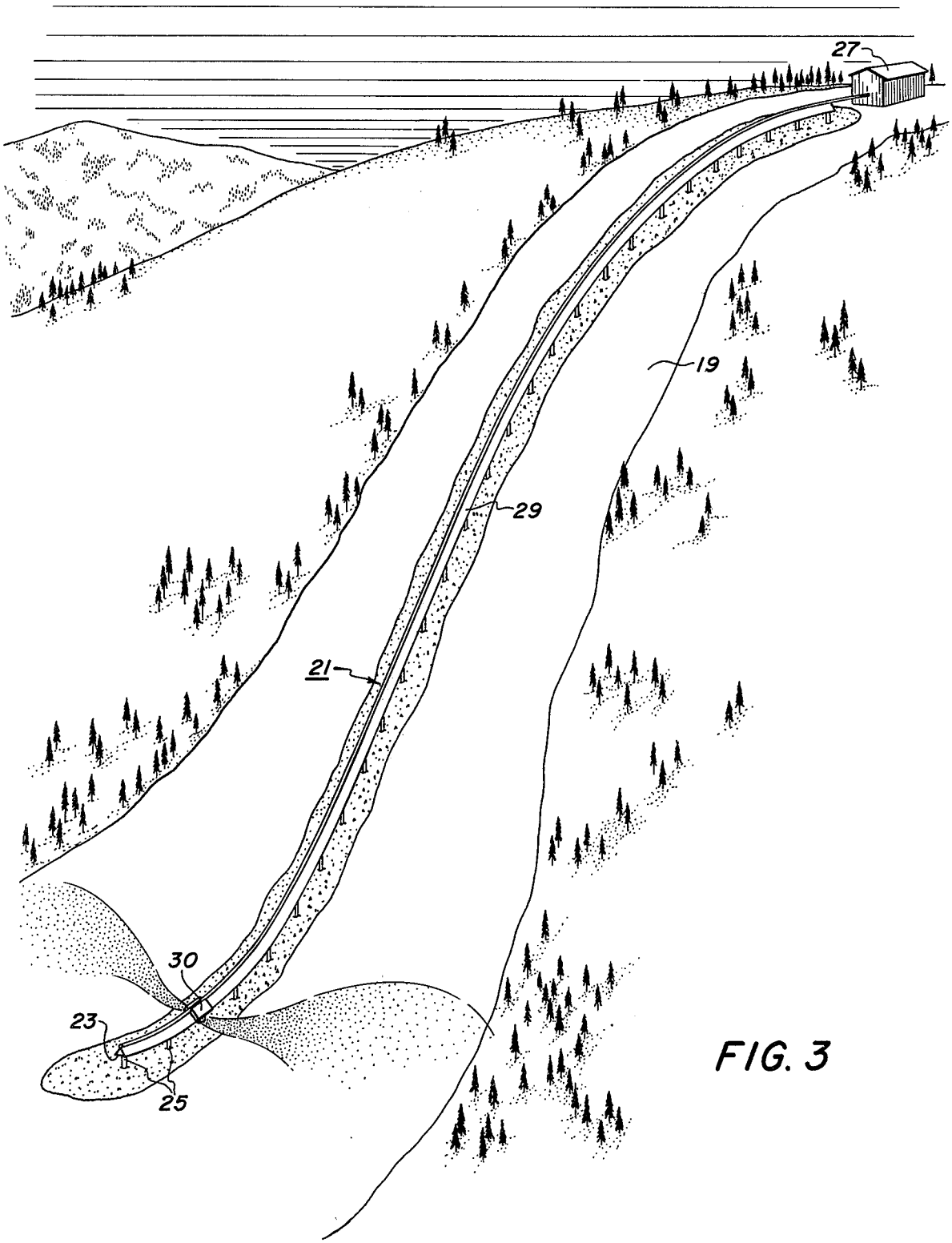
FIG. 3 is a perspective view illustrating a ski slope having apparatus installed thereon for producing snow in accordance with this invention.

FIG. 3 is a perspective view of a ski slope equipped with apparatus to make snow in accordance with this invention. In FIG. 3 there is shown ski slope 19 and along one side thereof a bank of ice on a support generally shown as 21. As an example, triangular support 23 as is shown in FIG. 1 runs the length of slope 19. Support 23 is supported by legs 25 so as to provide available space over which the inclined surface may spread without taking up an undesirable amount of ground space. Water delivery means 27 provides water from a source to the inclined surface 29. When sufficient ice has accumulated on surface 29, a comminuting device traverses the length of the surface 29, comminuting the ice and spreading it onto slope 19 in the form of snow.

Figure 4:
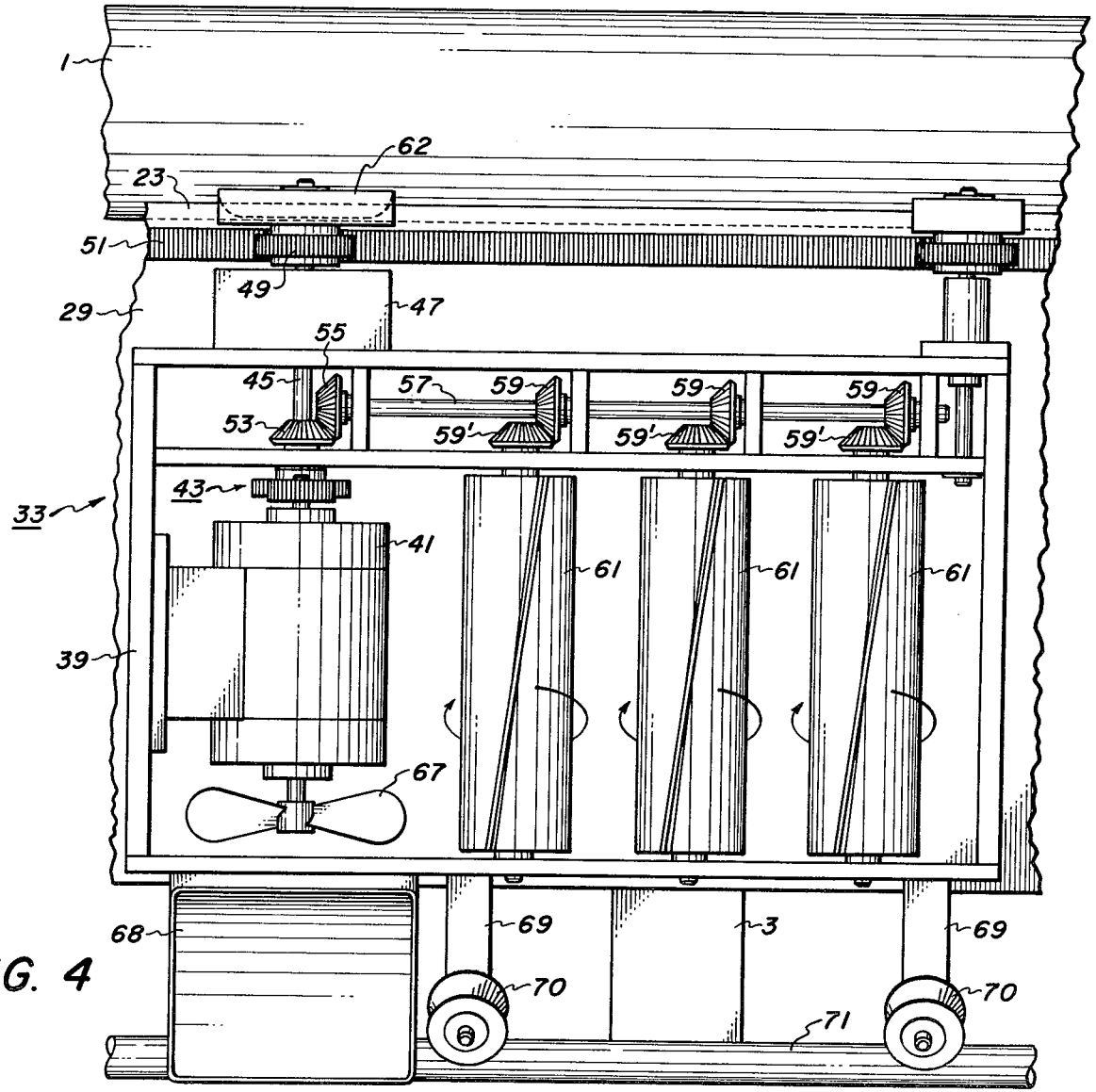
FIG. 4 is an exemplary device for comminuting the ice formed in accordance with this invention.

FIG. 4 describes one exemplary device which can be utilized to convert the ice into snow. For most skiing purposes the snow derived by shaving rather than chipping or otherwise breaking the ice is preferred. Thus, the device of FIG. 4 is generally designated 33 and comprises frame 39. On frame 39 is held drive motor 41 which propels the device along surface 29 by means of power train 43. Power train 43 includes drive shaft 45, transmission 47 and drive gear 49. Drive gear 49 engages rack gear 51 fixed to support 23. By rotation of drive gear 49, at reduced RPM, the entire device 33 is propelled along inclined surface 29.

Affixed to the higher RPM drive shaft 45 is blade drive gear 53 which engages gear 55 on shaft 57. Distributed along shaft 57 are drive gears 59 engaging driven gears 59'. Driven gears 59' are affixed to a shaft upon which are mounted blades 61. While blades 61 can take any suitable form, FIG. 4 illustrates spiral blades which rotate at high speed to shave the ice and produce a fine powder closely resembling snow.

Due to the rotation of the blades 61 the snow produced is thrown against baffles 63 and fall to a collecting baffle 65. Collecting baffle 65 slopes toward fan 67 which fan propels the snow onto the slope through chute 68.

The lower end of comminuting device 33 is supported by legs 69 which rest upon a means of support running along the bottom of the support carrying the ice. Legs 69 can contain rollers 70 or other aids to permit easy movement of the device along the bank of ice. The arrangement illustrated in FIG. 4 permits easy removal of comminuting device 33 from the support so that it can be moved from one ski slope to another as the production of snow is required.

Figure 5:
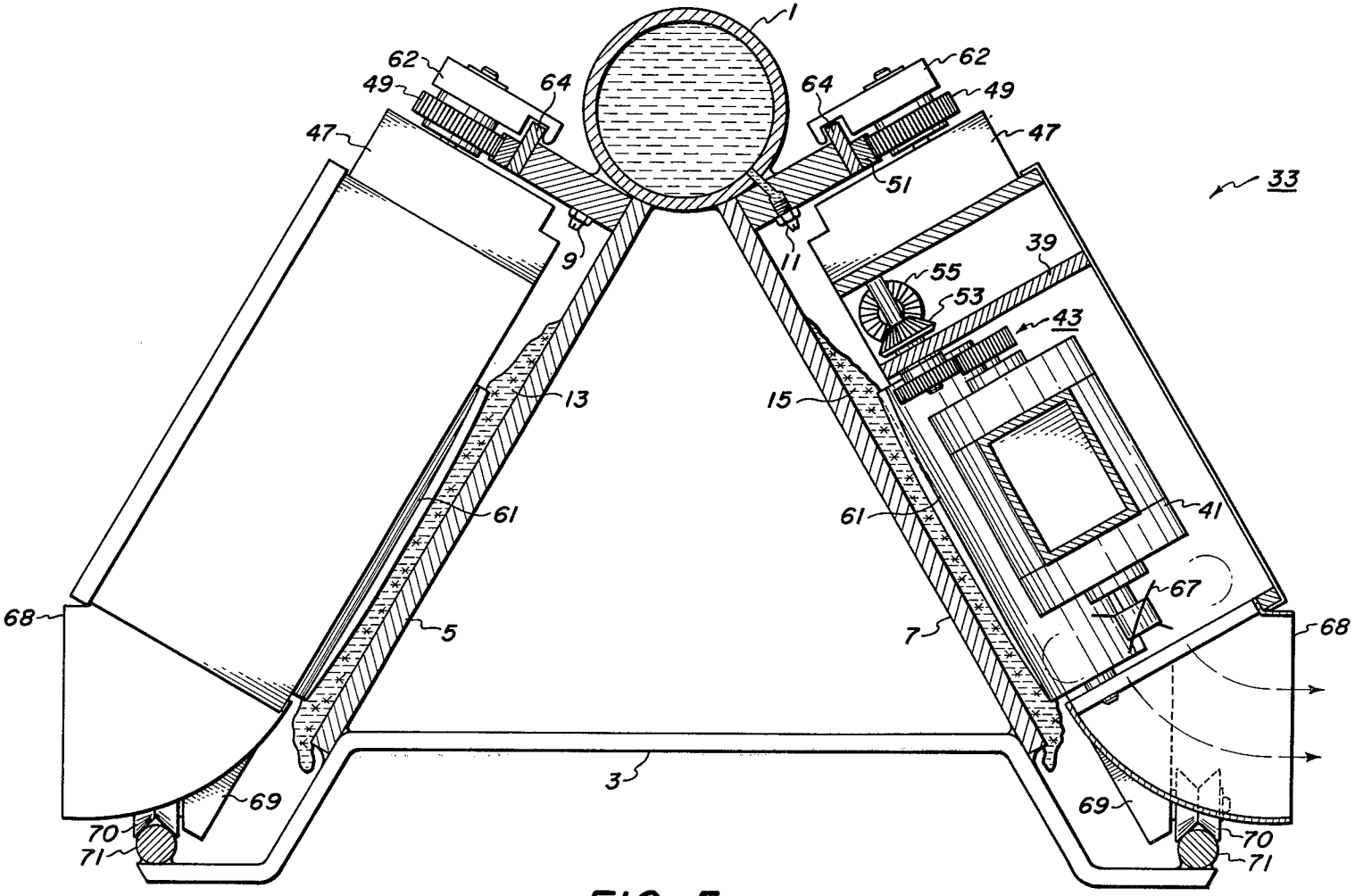
FIG. 5 is an end sectional view of the device in FIG. 1 having mounted thereon the comminuting device of FIG. 4 in operative position to convert the ice into snow.

In FIG. 5 there is shown an end sectional view of the apparatus of FIG. 4. Comminuting device 33 is shown resting on rail 71 extending from the base of triangular member 3. The upper portion is supported by drive gear 49 resting on rack gear 51. Blades 61 rest adjustably on the ice bank 15. As drive gear 49 turns, the device 33 is moved along the ice bank to engage blades 61 with new sections of ice 15. End plate 62 retains device 33 on the surface of ice 15 by bearing on flange 64 on rack gear 51.

Although FIGS. 3-4 illustrate one method in accordance with this invention to provide ice along a ski slope and means to convert the ice into snow, another, simpler, preferred method is achieved in accordance with this invention. Ice is provided by spraying water uniformly onto the snow of the slope at ambient atmospheric temperatures below the freezing point of water. The spray provides a thin layer of water on the snow of about $\frac{1}{3}$ mm per hour per degree Celsius below the freezing point of water. The thus formed ice over the snow is comminuted by crushing as by a device such as rollers, sieves, etc. driven over the snow. Since the volume of snow is about 5 to 10 times water or ice, a small amount of ice over the pre-existing snow will usually provide sufficient snow for purposes of skiing.

When spraying water on snow, the control of the amount placed upon the snow is crucial. Too much water will melt the pre-existing snow. Intermittent spraying of water on the snow is preferred to constant spray for the reason that the amount or addition rate is easier to control.

The method of this invention will be more clearly understood upon reading the following examples which are illustrative only. The following examples are not intended to limit the invention in any way.

DESCRIPTION OF THE PREFERRED EMBODIMENTS

EXAMPLE 1

A ski slope having about 30 cm. of snow on the ground is intermittently sprayed with water overnight during which time the temperature remains at about −10° C. The water addition equaled an ice accumulation of about 3 mm per hour onto the snow for a period of about 10 hours to provide a layer of ice over the snow having a thickness of about 30 mm. A device is driven along the slope which scoops or scrapes off the top crust of ice covering the snow and, by a rotary blade fluffs the snow and comminutes the ice into fine particles, then replacing the snow onto the slope. By this means an additional layer of about 150 mm. of snow is added to the ski slope.

EXAMPLE 2

To illustrate the relatively small amount of energy required to produce snow by shaving an ice bank as compared to a typical commercial compressed air system, the following test was conducted. Onto an ice pond was placed a pair of ice skates mounted on a frame to hold the blades verticle to the smooth surface of the ice and to which weights were added. A spring was attached to the frame on one side to pull the frame at a constant speed over a distance of 56 cm. The spring was calibrated to determine the amount of force required to move the frame. This turned out to be 3.1 kg force, or 30.4 newtons. At a temperature of about −12° C. the frame was moved over the above mentioned distance a total of 100 times in each direction. The snow produced by the shaving action of the skates was collected, melted and found to weigh about 0.3 kg. The energy required to produce the snow represented by the water was found by the formula $$W = F \times D$$

wherein W is the work or energy expended, F is the force applied over distance D. Substituting in the formula the data obtained, the amount of energy is calculated as follow:

$$W = 30.4 \text{ newtons} \times 112 \text{ m} = 3400 \text{ joules}$$

Thus the energy required is $(1.1) \times (10^4)$ J/kg of ice to convert the ice into snow. These figures were compared with actual results from a commercial scale operation using the compressed air and water method.

To produce an average of about 25 inches of snow over a ski slope having an area of about 32.7 acres one must provide sufficient ice equal to about $2 \times 10^4$ tons of water. From the above data one finds that the present method provides that amount of snow by shaving ice at the annual rate of about $4.15\times10^4$ kW-hr of energy. Of course, there is some energy expended to lift the water from a source such as a pond up a hill an average vertical distance of about 600 ft. The amount of energy required for supplying the water is found to be $8.3\times10^3$ kW-hrs per year for a total of $4.98\times10^4$ kW-hrs per year or 50 kW-hr/acre-inch. Slightly more than 1% additional energy is expended to distribute the snow over the slope.

As a comparison a typical compressed air system commercially available produces an equivalent amount of snow while consuming about 629 kW-hr/acre-inch.

EXAMPLE 3

An electric drill having a 1 inch diameter bit is utilized as an alternative means for determining the amount of energy required to convert ice into snow. The drill motor rated at 4 amperes at 115 V (460 Watts). With the drill a 1 inch diameter hole is drilled through a 4 inch block of ice in less than 2 seconds with no noticeable reduction in the RPM of the motor. A volume of ice equal to 52 g of ice is thus converted to snow of a fine quality with the expenditure of a maximum amount of energy of 18 Joules per gram. However, the rating of 4 amperes is for maximum power, which was not expended, and the actual consumption is less than is indicated in Example 2.

EXAMPLE 4

Another means for converting ice to snow is demonstrated by utilizing a dado cutter blade affixed to a radial arm saw. A smooth block of ice is cut to a depth of 1 cm; a width of 2 cm. and a length of 30 cm. The maximum energy expended is calculated from the power rating of the saw motor of 10 amps at 115 V or 1150 watts. The conversion required about ½ to ⅔ sec. for a maximum of energy in the range of from 10 to 14 joules/gram of ice.

EXAMPLE 5

To illustrate the critical nature of the rate of water addition as the major factor in efficiently forming ice, a shower head is set up to intermittently spray water on the snow covered ground. With the shower head elevated to a height of 4 meters above the snow a time controlled valve allowed water to spray from the head to the surface of the snow for a period of 1 sec. every 48 seconds. Index markers are placed on the ice to determine the rate of growth of the ice layer while the ambient atmospheric temperature is noted. The temperature during the test varied between −7° C. and −11° C. and the time of intermittent application of water extended over a period of 56 hours.

The spray of water on the snow produced a range of water addition rates from the center of a circular pattern where the rate is maximum, to the outer edge of the pattern, obviously where no water addition takes place. In the center of the pattern a great excess of water, above the rate of ⅓ mm per hour per degree Celsius below the freezing point, is added, which resulted in melting the snow present through to the ground. A ring of ice formed away from the central melted area, rising to a maximum quickly and then gradually decreasing as the farthest extent of water deposited is reached. The maximum height of the ice ring was found to be about 16 cm. and the average growth rate at the optimum location was about 0.76 cm/degree Celsius-day. Thus, by applying water to a flat surface to the extent it freezes before further addition, an optimum rate of ice formation is determined. This test indicates that water addition rate in the range of from about 0.3 mm to about 0.4 mm of ice formation/degree/hour is optimum for a horizontal surface.

EXAMPLE 6

The intermittent spray device of Example 5 is again utilized, but with the amount of spray time increased to about 1.9 seconds every 48 seconds or for about 4% of the total time. The intermittent spray continues for a period of 38 hours at an average temperature of −2.8° C.

As in Example 5 in the center of the circular pattern the snow melted and a solid ring of ice built up around the edge of the central area to a maximum height of 4.5 cm. which is equivalent to 0.42 mm per degree-hour, or 1.0 cm of ice per degree-day.

EXAMPLE 7

The procedure of Example 5 is repeated with the exception that the surface upon which the intermittent water spray was directed was placed in a nearly vertical position. The ice accumulation found in the area of optimum or maximum ice accumulation was found to exhibit a rate of 1.2 cm. per degree Celsius per day, or 0.5 mm per degree C. per hour.

As indicated in Example 2, the energy required to shave the ice to produce snow is about $1.1\times10^4$ joules/kg. Although shaving the ice adds energy, such amount of energy is too small to produce any serious loss of ice due to melting. For example, the amount of energy required to melt ice ;s $7.9\times10^4$ cal/kg, or 330 J/g, which is 30 times the amount added by shaving the snow. Should the ice be shaved well below freezing, no snow will melt, since the amount of heat added by the shaving operation only raises the temperature of the ice 2.7° C.

There are many advantages to providing snow for ski slopes in accordance with this invention other than the conservation of energy. For example, most systems utilizing high pressure also produce a very annoying loud sound which can be heard throughout the ski area. Also, the freezing water sprayed into the air by the high pressure systems coats the goggles and stings the faces of skiers using the slopes being supplied with snow. Likewise, nearby trees are sprayed upon the "guns" of the high pressure systems, whereupon the trees become loaded with ice and snow, often to the breaking point and beyond, thus damaging the trees.

Another advantageous feature of the method of this invention is the uality of the snow provided, particularly by shaving of the ice, in high pressure systems, often a heavy, dense snow is produced whereas the snow produced from comminuted ice is light, powdery and much more closely resembles natural snow. Obviously, the high pressure systems of the prior art cannot be operated during periods of high winds. However, the method of this invention can produce ice even more efficiently during such periods of high winds due to the actions of the wind to increase evaporation and conduction. Yet another advantage of the method of this invention over prior art methods is the ease of control of the system. Since relatively low water pressure can be utilized the water flow rate is easily controlled. Also, as snow is made by comminuting an ice bank it is distributed over the ski slope. Since no critical support is needed for equipment under high pressure, the ski slope receives snow in a well directed pattern with easily controlled snow blowing equipment. The operator can more readily direct the snow onto the most worn areas, most needful of extra snow.

The reaction to thawing and refreezing conditions are also believed to be advantageous when utilizing the method of this invention. During a thaw snow becomes packed by skiing, and, upon refreezing becomes extremely hard. In the present system, ice banks produced during periods of freezing weather melt very little compared with snow during periods of thawing and can be shaved immediately when freezing temperatures return, to provide a high quality snow for skiing. In fact, banks of ice produced in accordance with the process of this invention before the thaw and stored along the slopes can be shaved during periods of thaw to provide snow at any time.

Although the invention has been described in various embodiments with reference to the accompanying drawings, it is to be understood that the invention is not limited to the details shown and described, and that various changes and modifications can be made.

What is claimed:

1. A method of providing snow on a ski slope which comprises:

(a) providing a water distribution system along at least one side of said slope;

(b) providing a surface upon which water is deposited at an ambient atmospheric temperature below the freezing point of water along said ski slope from said distribution system;

(c) depositing water from said distribution system onto said surface at a rate substantially equal to the maximum rate of crystallization of said water on said surface, thereby forming a layer of ice on said surface, and;

(d) comminuting said ice and distributing the comminuted ice onto said slope.

2. A method of providing snow on a ski slope which comprises:

(a) providing a water distribution system along at least one side of said slope;

(b) providing a surface upon which water is deposited at an ambient atmospheric temperature below the freezing point of water along said ski slope from said distrubtion system;

(c) intermittently depositing water from said distribution system onto said surface at a rate such that the water placed on the surface freezes before additional water is deposited on said surface thereby forming a layer of ice on said surface, and;

(d) comminuting said ice and distributing the comminuted ice onto said slope.

3. The method of claim 2 wherein the surface is inclined at an angle from the horizontal.

4. The method of claim 3 wherein the water deposition is at the rate of about $\frac{1}{2}$ mm. of thickness per hour per degree C. below the freezing point of water of said ambient atmospheric temperature.

5. The method of claim 2 wherein the water deposition is at the rate of about $\frac{1}{3}$ mm. of thickness per hour, per degree C. below the freezing point of water of said ambient atmosphere.

6. The method of claim 2 wherein the ice is comminuted by means of shaving.

7. The method of claim 6 wherein the comminuted ice is distributed on said slope by means of blowing air.

* * * * *